United States Patent [19]

Freissmuth et al.

[11] 4,260,413

[45] Apr. 7, 1981

[54] DESULFURIZING COMPOSITION, PROCESS FOR PRODUCING THEM AND DESULFURIZATION OF PIG IRON AND STEEL

[75] Inventors: Alfred Freissmuth, Trostberg; Werner Gmöhling, Hufschlag; Heinrich Röck, Trostberg, all of Fed. Rep. of Germany

[73] Assignee: SKW Trostberg Aktiengesellschaft, Trostberg, Fed. Rep. of Germany

[21] Appl. No.: 60,149

[22] Filed: Jul. 24, 1979

[30] Foreign Application Priority Data

Aug. 4, 1978 [DE] Fed. Rep. of Germany ..... 2834216

[51] Int. Cl.[3] ..... C21C 7/02

[52] U.S. Cl. ..... 75/58; 75/53; 75/257

[58] Field of Search ..... 75/53, 58, 257

[56] References Cited

U.S. PATENT DOCUMENTS

| | | | |
|---|---|---|---|
| 3,957,502 | 5/1976 | Cull | 75/58 |
| 3,984,236 | 10/1976 | Koenig | 75/58 |
| 4,076,522 | 2/1978 | Yoshida | 75/58 |

*Primary Examiner*—P. D. Rosenberg

*Attorney, Agent, or Firm*—Curtis, Morris & Safford

[57] ABSTRACT

Improved desulfurization of ferrous melts is obtained by injecting into the melt a readily-flowable desulfurization composition composed of a desulfurization agent, such as calcium carbide or the like and, if desired, an additional component in which the particles are finely ground with about 3 to 20% by weight of carbon for at least about five minutes to coat the particles with a solid, lubricating coating of carbon.

12 Claims, No Drawings

DESULFURIZING COMPOSITION, PROCESS FOR PRODUCING THEM AND DESULFURIZATION OF PIG IRON AND STEEL

The present invention relates to desulfurizing compositions that are useful in the desulfurization of pig iron and steel, a process for producing such compositions and to an improvement in the desulfurization of pig iron and steel.

It is well known that the iron and steel industry has made extensive use of desulfurizing agents, such as calcium carbide, for the treatment of molten pig iron to effect desulfurization thereof. The desulfurizing agent is normally introduced into the melt in the form of a desulfurization composition containing the desulfurization agent in admixture with other components added for such purposes as increasing the flowability of the composition, promoting the distribution of the desulfurization agent in the melt and generally improving the desulfurizing effect of the desulfurization agent. More specifically, desulfurization compositions have been proposed that contain calcium carbide, calcium oxide, basic slags, magnesium, carbon, and mixtures thereof. Thus, for example, it has been proposed to admix calcium carbide with one or more components which split off a gas under the conditions in the melt in order to achieve a better mixing of the calcium carbide with the iron in the melt. Compounds suitable for such admixture with calcium carbide include alkaline-earth carbonates, diamide lime, a precipitated carbon-containing calcium carbonate formed as a by-product in an industrial process for the manufacture of dicyandiamide, calcium hydroxide, high molecular weight hydrocarbons and other additives which split off water or hydrogen under the conditions in the melt. The addition of carbon in different forms has also been recommended in order, i.a., to reduce the carbon dioxide released from the alkaline-earth carbonates by thermal decomposition to carbon monoxide and, in general, to assure reductive conditions at the site of the desulfurization reaction, see copending application Ser. No. 941,659 filed Sept. 12, 1978.

It is suggested, in U.S. Pat. No. 3,055,753 that desulfurization with a mixture of calcium carbide and amorphous carbon makes it possible to reduce the percentage of pig iron and correspondingly increase the percentage of scrap iron returns and steel in the cupola, thus making the process economically more efficient. U.S. Pat. No. 3,099,552 suggests treatment of a purified melt for desulfurization with a mixture of lime, finely divided silicon and graphite. U.S. Pat. No. 3,598,573 suggests use of a desulfurizing composition containing a finely divided calcium carbide admixed with a finely divided carbon-containing calcium carbonate or diamide lime.

It has been observed, however, that despite the various improvements heretofore suggested in the art, the effectiveness of the suggested desulfurizing agents still leaves a great deal to be desired inasmuch as the results, in terms of final sulfur content of the final product varies considerably despite efforts to maintain constant conditions in the desulfurization treatment. It is believed that this lack of uniformity of results is due at least in part to difficulties in uniformly introducing the desulfurization composition into the molten pig iron and that this in turn is caused by a lack of uniformity in the flowability of the desulfurization compositions. It is apparent that when the compositions do not have good flowability, they are frequently injected intermittently into the molten iron and that such intermittent contact of the iron with the desulfurization agent in the composition results in excessive desulfurization of some portions of the melt, insufficient desulfurization of other portions of the melt and undesirable increases in the development of slag. Furthermore, non-uniform, irregularly pulsating feeds or introductions of the composition into the molten iron can result in incomplete use of the desulfurization composition in that the solids of the composition are apt to pass through the melt, unreacted, within the gas bubbles of the conveying gas or the gas that is split off from a component of the composition, such unreactive solids being discharged as a dust above the surface of the melt. Under particularly aggrevated conditions, such intermittent feed can lead to spattering of the melt out of the ladle.

In view of the foregoing, it is believed that it is of decisive importance to a successful desulfurization treatment that the desulfurization agent be uniformly brought into contact with the molten pig iron. It is believed that a uniform and constant feed of the desulfurization agent and contact thereof with the molten iron is necessary to achievement of a substantially complete utilization of the desulfurization agent, a low final sulfur content in the molten pig iron and a uniformity of desulfurization throughout the melt. This cannot be achieved simply by utilization of suitable apparatus, such as that described in German Auslegungschrift No. 2,105,733, inasmuch as proper utilization of such apparatus requires a desulfurization composition in solid form which has intrinsically good flowability.

Efforts have already been made to improve the flowability of desulfurization agents by adding to them small amounts of silica in finely divided form. While some improvement has been obtained by such addition, it did not prove to be sufficiently effective in actual practice because pneumatic movement of such a composition from storage and introduction into the melt results in separating a portion of the silica, which is of relatively low density, from the remainder of the composition and thus in a non-uniform feed of desulfurization agent to the melt.

One of the primary purposes of the present invention is to provide a desulfurization composition comprising a mixture of desulfurization agent that is readily flowable and retains its flowability even upon extended storage.

This objective is achieved in accordance with the invention by grinding the desulfurization mixture, i.e., the mixture of desulfurization agent and any other component with which it is mixed, with graphite or carbon, preferably in the form of coal, until the particles of the desulfurizing agent are covered with carbon as a solid lubricant. With such solid lubricant coatings, the particles have greatly improved flowability and a practically unlimited storage life in the sense that they do not agglomerate so as to form lumps which can be broken up only with difficulty, if at all, and can be transported over considerable distances without impairment of their flowability. The desulfurizing action of the compositions thus prepared is greatly improved in that greater desulfurization is obtainable with a given quantity of desulfurization agent or, in order to obtain a given final sulfur content, a smaller amount of desulfurization agent is required. The desulfurization compositions of the invention have the additional advantage of greatly reducing problems due to formation of dust above the melt and formation of slag with the melt.

The graphite that is useful in accordance with the invention may be any ordinary commercial graphite such as naturally occuring or synthetically produced graphite, graphite concentrates, or graphite such as that produced in chemical reactions, e.g., by reaction of calcium carbide with nitrogen to form calcium cyanamide and by flotation of the diamide lime obtained upon production of cyanamide solutions from calcium cyanamide. In addition to graphite, it is also within the scope of the invention to utilize coal for grinding with the desulfurization agent or mixture to increase the flowability of the composition. Coking coal, bituminous coal and anthracite coal, especially high volatile coal, are suitable for this purpose. The preference for graphite is based on the fact that it does not readily ignite spontaneously in a finely ground condition and therefore presents no problem upon fluidization and conveyance of the desulfurizing composition by air.

The proportion of carbon in the form of graphite or coal that is added to obtain optimum flowability depends on the composition of the desulfurization agent. Thus, for example, mixtures of calcium carbide and alkaline-earth carbonates require somewhat greater additions than, for instance, mixtures of calcium carbide and diamide lime, which already contain a certain amount of carbon as previously indicated. Generally, an addition of about 3 to 20% by weight of carbon based on the weight of the desulfurization composition is enough to provide desirable flowability. Preferably, 5 to 10% by weight of carbon are added. The addition of the carbon to the desulfurization mixture can be effected by any suitable means such as in a tube mill which may be equipped with ordinary grinding bodies such as rods, balls, etc. and this addition and grinding can be accomplished with or after addition of the non-desulfurizing components so that a complete covering of the previously formed particles is obtained.

The effectiveness of the desulfurization composition prepared in this manner depends not only on the percentage or proportion of carbon that is added but also on the duration of the grinding and the particle size of the ground material. Mere admixing of the carbon without simultaneous grinding results in practically no improvement of the desulfurizing action inasmuch as there is very little, if any improvement in the flowability of the composition. Optimum desulfurizing action is obtained only if the granules of the mixture of composition are substantially surrounded or enclosed by a solid lubricating film of carbon which, in turn, results in excellent flowability. The duration of the grinding with carbon to obtain maximum flowability of the composition is, of course, dependent on the technical characteristics of the mill in which the grinding is accomplished. Generally, a minimum of about five minutes grinding time is necessary in order to achieve any meaningful effect, while a grinding time of ten to thirty minutes usually results in optimum flowability and therefore maximum effectiveness of the composition as a desulfurization means.

Optimum results are accordingly obtained by adding from 5 to 10% by weight of graphite to a desulfurization mixture and grinding this mixture for ten to twenty minutes in a tube mill.

It has been found that the addition of carbon, followed by or simultaneously with grinding, is capable of improving the activity of all ordinary desulfurizing agents including particularly mixtures of calcium carbide with alkaline-earth carbonates or hydroxides such as calcium carbonate and calcium hydroxide, dolomite and other additives such as alkali carbonates, fluorspar, high-molecular weight organic hydrocarbons and mixtures of calcium carbide with diamide lime already containing about 10% by weight carbon in the form of graphite. As expected, the degree of improvement of the composition that is achieved is somewhat less pronounced when applied to mixtures containing diamide lime than in the case of mixtures which do not already contain carbon.

The effectiveness of adding graphite or coal and grinding the mixture is not limited to mixtures which contain calcium carbide as the desulfurizing agent. Mixtures of calcium oxide or aluminum oxide with or without a metal such as magnesium, aluminum, and possibly other components that are known to be suitable for deep desulfurization in open ladles are also improved by addition of and grinding with graphite or coal. It appears that the coating of the particles or granules avoids separation of the composition, which customarily takes place rapidly, into metallic and non-metallic components. In some circumstances, it may be found advisable to first grind the non-metallic component or components with the carbon and thereafter to admix the substantially pulverized metal with the coated particles.

These and other embodiments of the invention will become more apparent from the following examples:

EXAMPLE 1

A. 4.2 kg of a desulfurizing composition consisting of a mixture of 65% by weight finely ground calcium carbide and 35% by weight of finely ground sub-hydrated lime, a calcium hydroxide which contains less water than corresponding to the formula $Ca(OH)_2$, calcium oxide being still present, per ton of pig iron were injected into a melt in an approximately 190 ton torpedo ladle. The desulfurization composition contained no carbon additive and had a particle size of $80\% < 63\mu$. The use of sub-hydrated lime avoids liberation of acetylene upon contact of the lime with the carbide. It was noted from the variations of pressure in the injection system that the mixture was poorly conveyed, i.e., nonuniformly injected into the melt. Unusually heavy clouds of white dust escaped from the molten pig iron. This dust was desulfurizing agent that had passed through the melt enclosed in gas bubbles and was, therefore, only partly effective in desulfurizing the iron.

It was found that, on the average, the sulfur content of the pig iron was reduced from 0.033% to 0.016%.

B. In another test, 3.4 kg per ton of pig iron of a desulfurizing composition composed of 65% by weight calcium carbide intensively ground and mixed in a tube mill with 30% by weight sub-hydrated lime and 5% by weight natural graphite was injected into a pig iron melt under the same conditions as described in part A. The particle size of the composition was essentially the same as that in part A. It was noted that the composition was considerably more easily conveyed and more uniformly injected into the melt. The surface of the melt was brought to a boil uniformly and without sudden eruptions and no unusual liberation of dust above the melt was observed, leading to the conclusion that the desulfurization agent had been uniformly stirred into the molten pig iron and absorbed.

The sulfur content of the pig iron was reduced from an average of 0.035% to 0.017%.

It is apparent from parts A and B of this example that the grinding of the desulfurizing agent with graphite resulted in a substantially equal desulfurization with approximately 20% less desulfurizing agent although the concentration of calcium carbide, the actually desulfurizing agent, was the same in both instances.

EXAMPLE 2

A. A desulfurization mixture consisting of 65% by weight calcium carbide and 35% by weight diamide lime, both components of which had been finely ground together in a tube mill, was injected into molten pig iron for desulfurization at an average rate of 3.5 kg per ton of pig iron. This mixture is commercially available and is manufactured on a large scale for use in desulfurization of pig iron in torpedo ladles. The diamide lime contains about 10% by weight graphite which, in addition to maintaining reductive conditions, also promotes flowability of the mixture. This mixture therefore can be pneumatically conveyed, dosed with corresponding uniformity and has excellent desulfurizing effectiveness. If use resulted in reducing the sulfur content of the melt from 0.45% to 0.015%.

B. The test reported in part A of this example was essentially repeated except that the desulfurization composition was composed of a mixture of 65% by weight calcium carbide, 30% by weight of the same diamide lime and 5% by weight of anthracite that was ground into the mixture of carbide and lime by grinding the dry components in a tube mill for from 15 to 25 minutes. It was found that the flowability had been further improved and that the desulfurization action was 5 to 10% greater than that achieved in accordance with the procedure described in part A. Only 3.1 to 3.3 kg of desulfurizing composition per ton of pig iron were consumed to reduce the sulfur content from an average of 0.045% to 0.015%.

EXAMPLE 3

A comparison was made of the effectiveness of desulfurization compositions consisting of mixtures of powdered magnesium with quicklime or alumina in which the quicklime was and was not intensively ground with high volatile coal and the compositions were used for deep desulfurization of pig iron in open ladles. These desulfurization compositions, when not ground with carbon, have a very strong tendency to separate into their individual components. The magnesium readily accumulates in separate zones and on the surface of the mixture. This separation is very disadvantageous inasmuch as the magnesium passes into the melt upon injection in a non-uniform manner, resulting in suddenly increased development of magnesium vapors and consequently to a spattering of molten iron out of the open ladles.

It was found that when the desulfurization composition was prepared from 50% by weight powdered magnesium and 50% by weight of quick lime intensively ground for 12 to 20 minutes with 5% by weight high volatile coal, it possessed excellent flowability and was easily and uniformly conveyed pneumatically into the melt without any noticeable tendency towards separation into its components even when subjected to pneumatic loosening and blowing into a storage vessel or a distributor for the powdered material. The uniform pneumatic conveyance of the composition resulted in a uniform dosage and thus also in a uniform development of magnesium vapor in the melt. The gas escaping from the high volatile coal in the heat of the melt also promoted a uniform agitating effect since these gases are, unlike the magnesium vapor, dissolved by the molten iron. These gases have reductive properties and therefore act as a protective gas with respect to the magnesium.

It was found that injection of a desulfurizing composition composed of 50% by weight powdered magnesium and 50% by weight quick lime intensively ground with high volatile coal into a 140 ton transfer ladle resulted in a desulfurization of a number of pig iron heats from an initial sulfur content of 0.022% to less than 0.05% without any irregularities being observable in the discharge or the injection, or any spattering of liquid metal. Under otherwise equal conditions, approximately 10% less mixture i.e., 390 kg instead of 430 kg of desulfurizing composition per ton of pig iron, was consumed when the composition was used in place of a similar mixture of magnesium and powder and quicklime that was not ground with coal. This desirable result is believed to be due to the better uniformity of the introduction of the magnesium and the furthermore constant intensive agitating effect of the mixture.

We claim:

1. A process for the production of a powdered, readily-fluidizable composition for desulfurizing molten pig iron and steel which comprises grinding a desulfurizing agent being 80% $<63\mu$ in size for 5 to 30 minutes with about 3 to 20% by weight of carbon.

2. The process defined in claim 1 wherein the carbon content is from 5 to 10% by weight.

3. The process defined in claim 1 wherein one component of the desulfurizing agent is ground with carbon and an additional component is admixed subsequently.

4. The process defined in claim 1 wherein the carbon is graphite and the time of grinding is 10 to 20 minutes.

5. The process defined in claim 1 wherein the grinding is accomplished in a tube mill.

6. A readily-fluidizable composition for desulfurizing molten pig iron or steel which comprises a desulfurizing agent in the form of finely ground particles of 80% of the particles being $<63\mu$ in size, coated with about 3 to 20% by weight carbon.

7. The composition defined in claim 6 wherein the amount of carbon with which the particles are coated is about 5 to 10% by weight.

8. The composition defined in claim 6 wherein the carbon with which the particles are coated is graphite.

9. The composition defined in claim 6 wherein the desulfurizing agent is finely divided calcium carbide.

10. The composition defined in claim 6 wherein the desulfurizing agent is a mixture of finely divided calcium carbide and diamide lime.

11. The composition defined in claim 6 wherein the desulfurizing agent is a mixture of finely divided calcium carbide and sub-hydrated lime.

12. A process for desulfurizing pig iron and steel which comprises introducing into a melt thereof a desulfurizing proportion of a composition as defined in claim 6.

* * * * *